US011484807B2

(12) United States Patent
Wang

(10) Patent No.: US 11,484,807 B2
(45) Date of Patent: Nov. 1, 2022

(54) APPLE-SHAPED LIGHT-EMITTING BALLOON

(71) Applicant: Bo Wang, Baoding (CN)

(72) Inventor: Bo Wang, Baoding (CN)

( * ) Notice: Subject to any disclaimer, the term of this patent is extended or adjusted under 35 U.S.C. 154(b) by 145 days.

(21) Appl. No.: 17/026,354

(22) Filed: Sep. 21, 2020

(65) Prior Publication Data

US 2021/0170293 A1 Jun. 10, 2021

(30) Foreign Application Priority Data

Dec. 9, 2019 (CN) ..... 201922233853.0

(51) Int. Cl.
*A63H 27/10* (2006.01)
*F21S 9/02* (2006.01)
*F21Y 115/10* (2016.01)

(52) U.S. Cl.
CPC ..... *A63H 27/10* (2013.01); *F21S 9/02* (2013.01); *A63H 2027/1033* (2013.01); *A63H 2027/1058* (2013.01); *A63H 2027/1075* (2013.01); *F21Y 2115/10* (2016.08)

(58) Field of Classification Search
CPC ..... A63H 27/10; F21S 9/02
See application file for complete search history.

(56) References Cited

U.S. PATENT DOCUMENTS 4,463,513 A * 8/1984 Wallace ..... A63H 27/10 446/222
6,012,826 A * 1/2000 Chabert ..... F21V 3/026 362/267

* cited by examiner

*Primary Examiner* — Thomas M Sember
(74) *Attorney, Agent, or Firm* — Jeenam Park

(57) ABSTRACT

The present disclosure provides an apple-shaped light-emitting balloon. The apple-shaped light-emitting balloon includes a balloon body and a connecting rod. The connecting rod is positioned in the balloon body. The upper part and the lower part of the balloon body are fixed to the connecting rod respectively. An air inlet and an air outlet are formed in the connecting rod. A light-emitting part is further arranged in the balloon body. When the balloon is blown up, the connecting rod keeps a fixed distance between the upper part and the lower part of the balloon, so that the balloon is similarly apple-shaped, and the balloon is able to emit light.

6 Claims, 2 Drawing Sheets

APPLE-SHAPED LIGHT-EMITTING BALLOON

TECHNICAL FIELD

Technical Field

The disclosure relates to the field of toy ornaments, in particular to a balloon capable of being blown into an apple shape and emitting light.

Background

Balloon is a toy, and is also an ornament commonly used in holidays and festivals to highlight atmosphere. Christmas is an important festival of Christianity and Catholicism, while Chinese believers express blessing of peace with apples at Christmas Eve, and Christmas Eve apple is the partial tone of apple, so that the apples are popular fruits at Christmas Eve. At present, balloons are mainly spherical when being blown up and cannot automatically form apple shapes, and if the balloons can form the apple shapes, light-emitting adornment is supplemented, so that the popularity degree of the balloons can be improved undoubtedly, and the sales volume can be increased.

SUMMARY

The disclosure aims to provide an apple-shaped light-emitting balloon, the balloon can form an apple shape after being blown up, can emit light, and is favorable for improving the festival atmosphere of Christmas Eve, improving the acceptance level and increasing the sales volume.

In order to achieve the above purpose, the disclosure adopts the following technical scheme:

An apple-shaped light-emitting balloon comprises a balloon body and a connecting rod, and is characterized in that the connecting rod is positioned in the balloon body, the upper part and the lower part of the balloon body are fixed to the connecting rod respectively, an air inlet and an air outlet are formed in the connecting rod, a light-emitting part is further arranged in the balloon body, and when the balloon is blown up, the connecting rod keeps a fixed distance between the upper part and the lower part of the balloon, so that the balloon is similarly apple-shaped.

Preferably, the connecting rod comprises an upper connecting part and a lower connecting part, and the light-emitting part is arranged on the connecting rod.

Preferably, a cavity is formed in the connecting rod, a light-emitting diode and batteries are arranged in the cavity, the lower connecting part is arranged on the cavity, the air inlet is formed in the bottom of the cavity, and the air outlet is formed in the upper part of the cavity.

Preferably, the cavity comprises a cavity seat and a cavity cover, the cavity seat is arranged on the connecting rod, and the cavity cover is buckled on the cavity seat.

Preferably, a battery clamping groove and a light-emitting diode clamping groove are formed in the cavity seat, the batteries are clamped in the battery clamping groove, and the light-emitting diode is clamped in the light-emitting diode clamping groove.

Preferably, the batteries and light-emitting diode are positioned in a housing, and the housing is positioned in the cavity seat.

Preferably, the batteries are connected in series, an insulation sheet is arranged between the batteries, the insulation sheet stretches out of the balloon through the air inlet, and the cavity is made of a transparent or semitransparent material.

Preferably, the upper connecting part is an upper annular groove formed in the top of the connecting rod, the lower connecting part is a lower annular groove formed in the lower part of the cavity, the top of the balloon is fixed to the upper annular groove, and an opening of the balloon is fixed to the lower annular groove.

In the technical scheme, the upper part (mostly the top) and the lower part (mostly the opening) of the balloon are connected through the connecting rod. In this way, when the balloon is blown up from the opening of the balloon, air enters through the air inlet and is exhausted into the balloon through the air outlet, the distance between the top and the opening is kept unchanged when the balloon inflates, and other parts inflate, so that the top and the opening of the balloon are pressed inwards relative to other parts of the balloon, and a shape similar to an apple is formed. The cavity is formed in the connecting rod, the batteries and the light-emitting diode for emitting light are arranged in the cavity, interestingness can be enhanced through light emitting, and the festival atmosphere is promoted.

DETAILED DESCRIPTION

Figure 1:
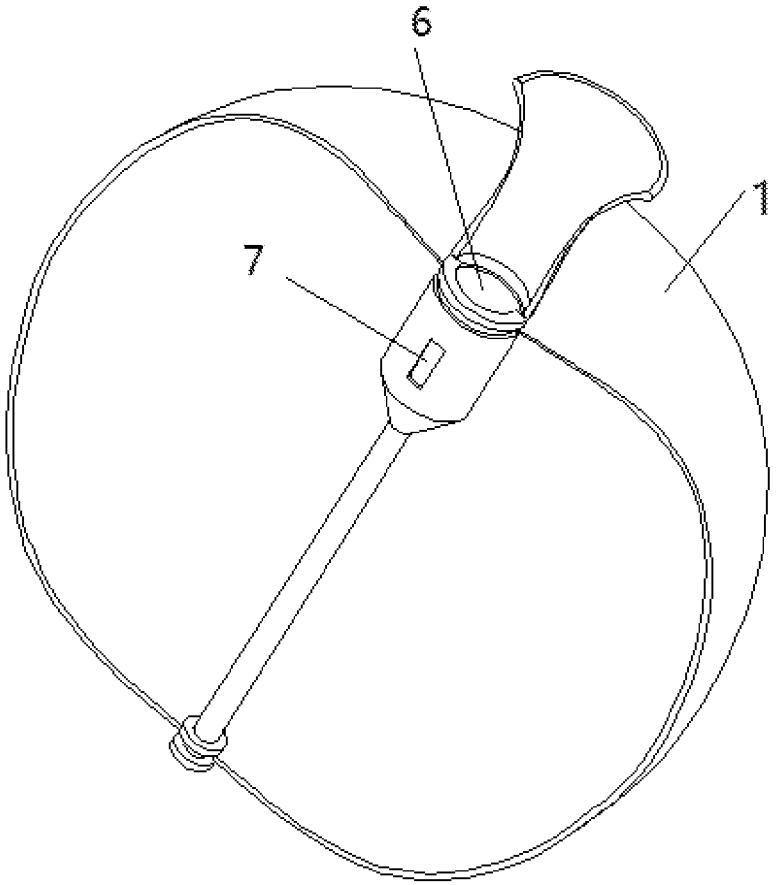
FIG. 1 is a structure diagram of a section view of the disclosure.
Figure 2:
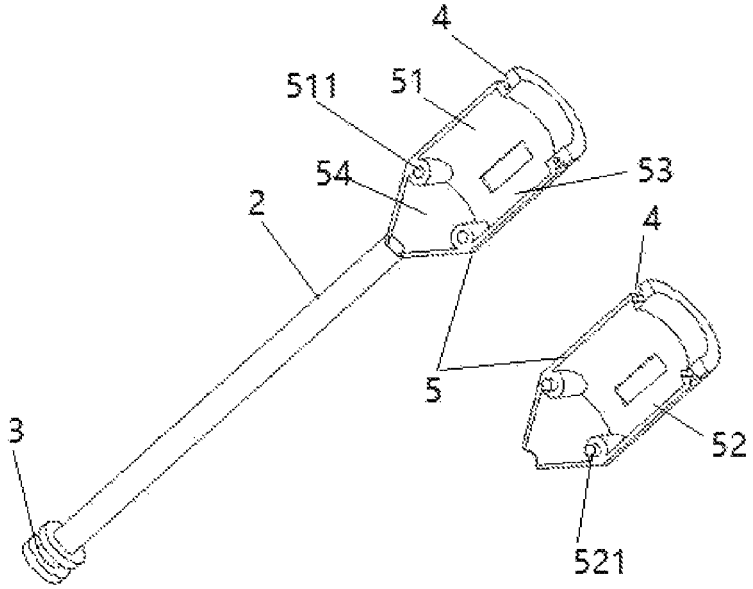
FIG. 2 is a structure exploded drawing of a connecting rod.
Figure 3:
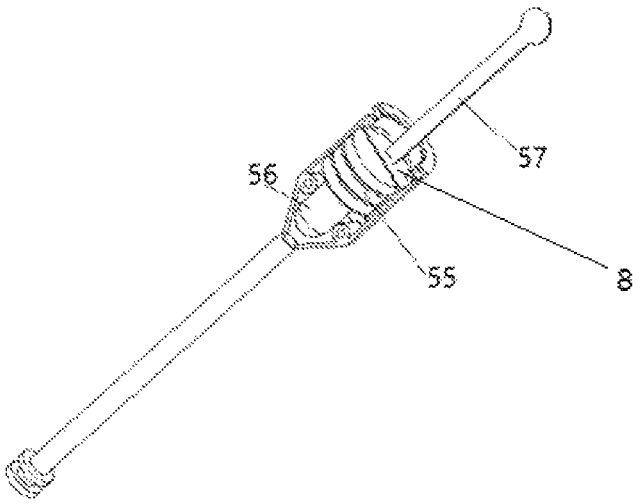
FIG. 3 is a structure diagram of the connecting rod in which batteries and a light-emitting rod are placed.

The disclosure is further described in conjunction with the following accompanying diagrams:

As shown in figures, an apple-shaped light-emitting balloon comprises a balloon body 1 and a connecting rod 2, the connecting rod 2 is positioned in the balloon body 1, and the upper part and the lower part of the balloon body 1 are fixed to the connecting rod 2. The upper end of the connecting rod 2 is provided with an upper connecting part, the lower end of the connecting rod 2 is provided with a lower connecting part, the upper connecting part is connected with the upper part of the balloon, and the lower connecting part is connected with the lower part of the balloon. In one embodiment, the upper connecting part is an upper annular groove 3 formed in the upper end of the connecting rod, the lower connecting part is a lower annular groove 4 formed in the lower part of the connecting rod, the top of the balloon 1 can sleeve the upper annular groove 3 through a rubber band, and an opening at the lower part of balloon sleeves the lower annular groove 4 through a rubber band. A cavity 5 is formed in the connecting rod and comprises a cavity seat 51 and a cavity cover 52, a battery clamping groove 53 and a light-emitting diode clamping groove 54 are formed in the cavity seat 51, batteries 55 are placed in the battery clamping groove 53, a light-emitting diode 56 is placed in the light-emitting diode clamping groove 54, and the light-emitting diode 56 and the batteries 55 form a closed loop to enable the light-emitting diode to emit light. Before use, an insulation sheet 57 is inserted between two adjacent batteries to cut off a circuit, and the insulation sheet 57 is pulled out when light needs to be emitted. A clamping tongue 521 is arranged on the cavity cover 52 and is clamped into a clamping seat 511 of the cavity seat 51, so that the cavity cover 52 and the cavity seat 51 form a complete cavity 5. An air inlet 6 is formed in the lower part of the cavity 5, an air outlet 7 is formed in the upper part of the cavity, air enters the cavity from the air inlet 6 and is exhausted into the balloon body through the air outlet 7, so that the balloon is blown up, the top and the lower part of the balloon are pulled by pull rods, the top and the lower part of the inflated balloon sink towards the interior of the balloon and are apple-shaped similarly, and finally the opening of the balloon is tightened.

In one embodiment, the batteries and the light-emitting diode are placed in a housing 8, the shell is placed in the cavity 5, and after the insulation sheet between the batteries is pulled out, light is emitted.

The cavity part is partially made of a transparent or semitransparent material.

The light-emitting part can also be arranged outside the connecting rod, but is positioned in the balloon.

The embodiment is merely one explanation of concept and implementations of the disclosure, but is not limited, and under the concept, of the disclosure, technical schemes that are not materially transformed are still within the scope of protection.

What is claimed is:

1. An apple-shaped light-emitting balloon, comprising a balloon body and a connecting rod, characterized in that the connecting rod is positioned in the balloon body, an upper part and a lower part of the balloon body are fixed to the connecting rod respectively, an air inlet and an air outlet are formed in the connecting rod, a light-emitting part is further arranged in the balloon body, and when the balloon is blown up, the connecting rod keeps a fixed distance between the upper part and the lower part of the balloon, so that the balloon is similarly apple-shaped, the connecting rod comprises an upper connecting part and a lower connecting part, and the light-emitting part is arranged on the connecting rod, a cavity is formed in the connecting rod, the upper connecting part is an upper annular groove formed in a top of the connecting rod, the lower connecting part is a lower annular groove formed in a lower part of the cavity, the top of the balloon is fixed to the upper annular groove, and an opening of the balloon is fixed to the lower annular groove.

2. The apple-shaped light-emitting balloon according to claim 1, characterized in that a light-emitting diode and batteries are arranged in the cavity, the lower connecting part is arranged on the cavity, the air inlet is formed in a bottom of the cavity, and the air outlet is formed in an upper part of the cavity.

3. The apple-shaped light-emitting balloon according to claim 2, characterized in that the cavity comprises a cavity seat and a cavity cover, the cavity seat is arranged on the connecting rod, and the cavity cover is buckled on the cavity seat.

4. The apple-shaped light-emitting balloon according to claim 3, characterized in that a battery clamping groove and a light-emitting diode clamping groove are formed in the cavity seat, the batteries are clamped in the battery clamping groove, and the light-emitting diode is clamped in the light-emitting diode clamping groove.

5. The apple-shaped light-emitting balloon according to claim 3, characterized in that the batteries and light-emitting diode are positioned in a housing, and the housing is positioned in the cavity seat.

6. The apple-shaped light-emitting balloon according to claim 2, characterized in that the batteries are connected in series, an insulation sheet is arranged between the batteries, the insulation sheet stretches out of the balloon through the air inlet, and the cavity is made of a transparent or semi-transparent material.

* * * * *